US011181255B2

(12) United States Patent
Crawford

(10) Patent No.: US 11,181,255 B2
(45) Date of Patent: Nov. 23, 2021

(54) LUMINAIRE INSTALLATION APPARATUS AND METHODS

(71) Applicant: ABL IP Holding LLC, Atlanta, GA (US)

(72) Inventor: Kaitlyn T. Crawford, Atlanta, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/675,850

(22) Filed: Nov. 6, 2019

(65) Prior Publication Data

US 2021/0131650 A1 May 6, 2021

(51) Int. Cl.

| | |
|---|---|
| ***F21V 21/02*** | (2006.01) |
| ***F21S 8/00*** | (2006.01) |
| ***F21V 21/088*** | (2006.01) |
| ***F21V 17/18*** | (2006.01) |

(52) U.S. Cl.

CPC ..... *F21V 21/02* (2013.01); *F21S 8/033* (2013.01); *F21S 8/036* (2013.01); *F21V 17/18* (2013.01); *F21V 21/088* (2013.01)

(58) Field of Classification Search

CPC ..... F21V 21/02; F21V 21/088; F21V 17/18; F21S 8/033; F21S 8/036

See application file for complete search history.

(56) References Cited

U.S. PATENT DOCUMENTS 2,490,191 A * 12/1949 Baker ..... F21V 17/18 362/223
2,851,588 A 9/1958 Bodian et al.
3,918,751 A * 11/1975 Blake ..... E05C 3/30 292/126
5,172,976 A 12/1992 Bogdanovs
6,392,146 B1 * 5/2002 Tai ..... F21S 8/033 174/481
6,881,003 B1 4/2005 Zeller et al.
2017/0288377 A1 * 10/2017 Ellis ..... F21S 8/033

OTHER PUBLICATIONS

"Silhouette Sconce Installation Instructions", Winona, 2402231 Rev. D ECO 15-3030, Available Online At: https://winonalightinq.acuitybrands.com/, released Jul. 25, 2019 (Year: 2019).*
"Silhouette Sconce Installation Instructions", Winona, 2402231 Rev. D ECO 15-3030, Available Online At: https://winonalighting.acuitybrands.com/, released Jul. 25, 2019, 2 pages.

* cited by examiner

*Primary Examiner* — Rajarshi Chakraborty
*Assistant Examiner* — Nathaniel J Lee
(74) *Attorney, Agent, or Firm* — Kilpatrick Townsend & Stockton LLP

(57) ABSTRACT

Apparatus for coupling a luminaire with a surface includes a mounting plate having or more studs extending therefrom, a back plate for a luminaire, and a latch. The back plate forms slots that can receive the studs. The back plate can move in a first direction with the studs received within the slots. The latch couples with the back plate, and can engage one of the studs that extends through one of the slots. In a first rotational position of the latch with respect to the back plate, the latch does not engage the stud, and in a second rotational position of the latch with respect to the back plate, the latch engages the stud in a direction different from the first direction, so as to constrain movement of the back plate in the first direction, latching the back plate to the mounting plate.

15 Claims, 8 Drawing Sheets

FIG. 3
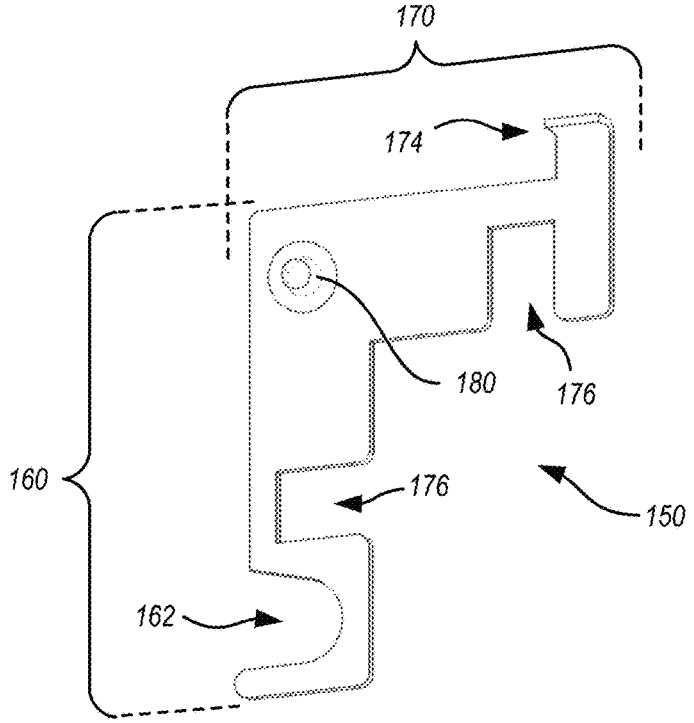
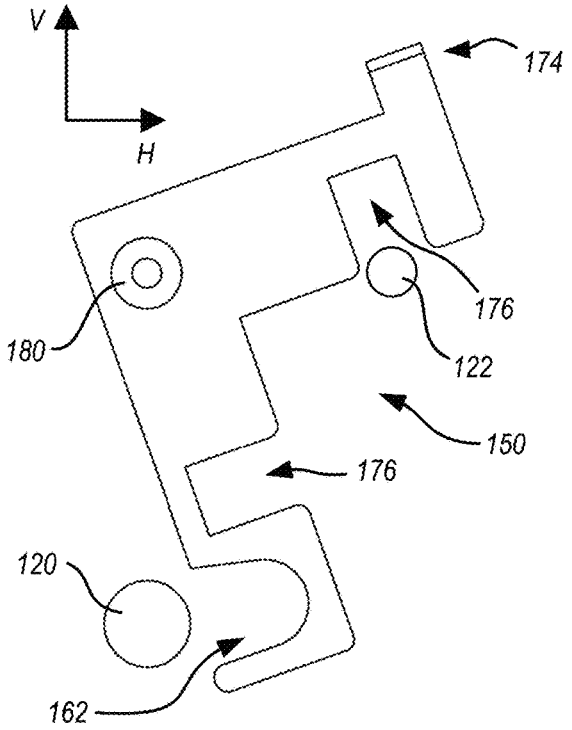
FIG. 4A
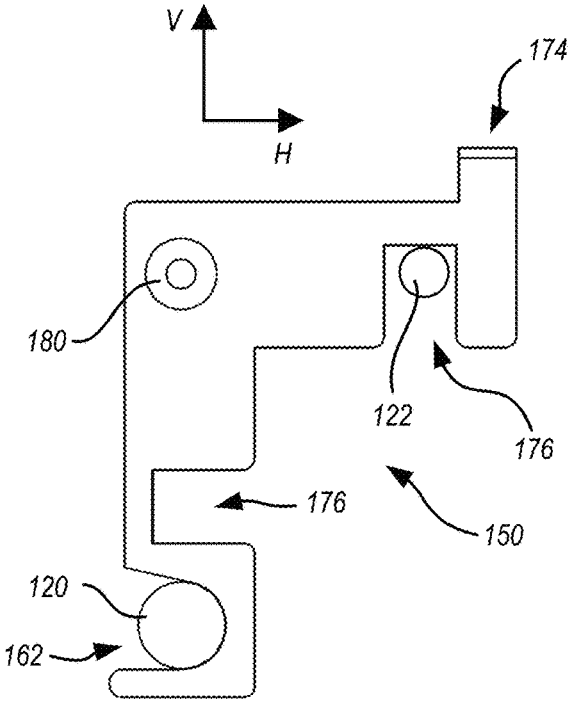
FIG. 4B

FIG. 6A
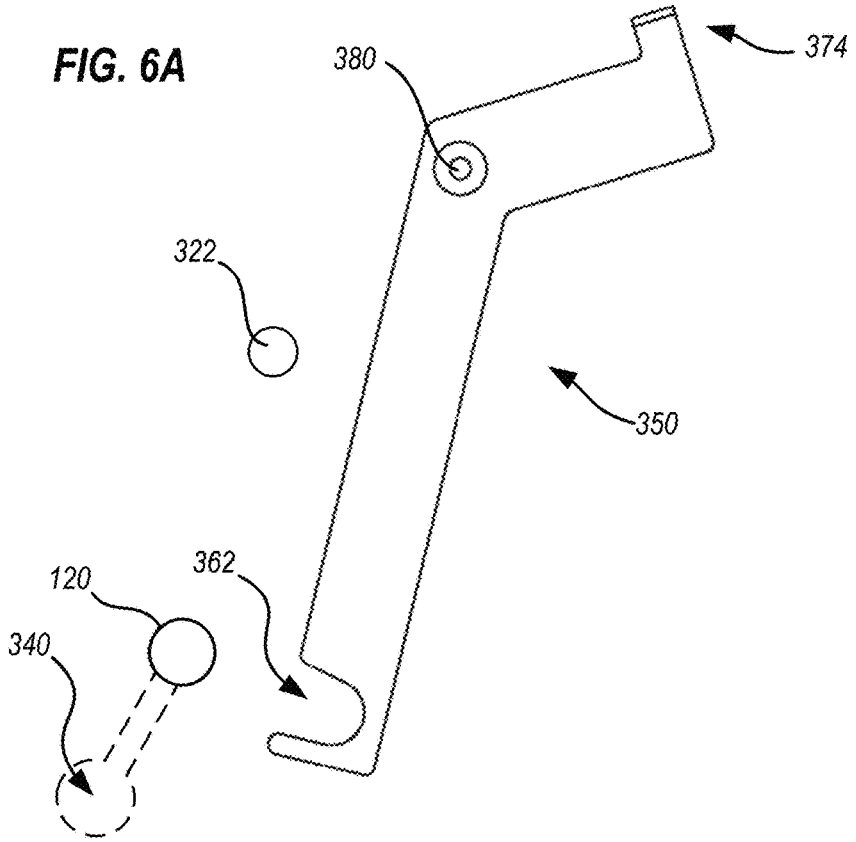
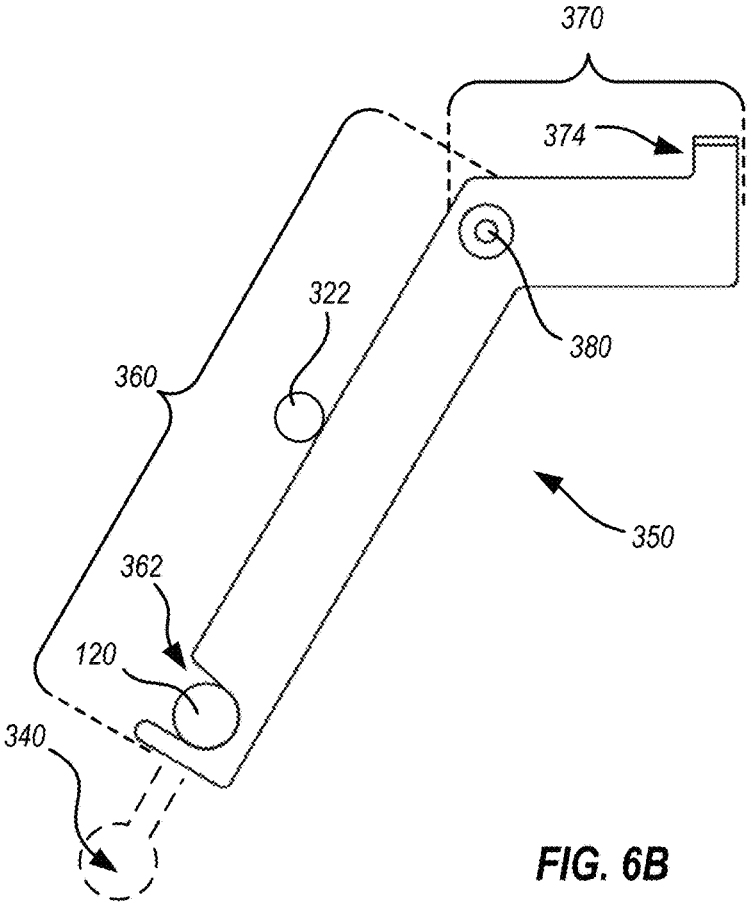
FIG. 6B

FIG. 7A
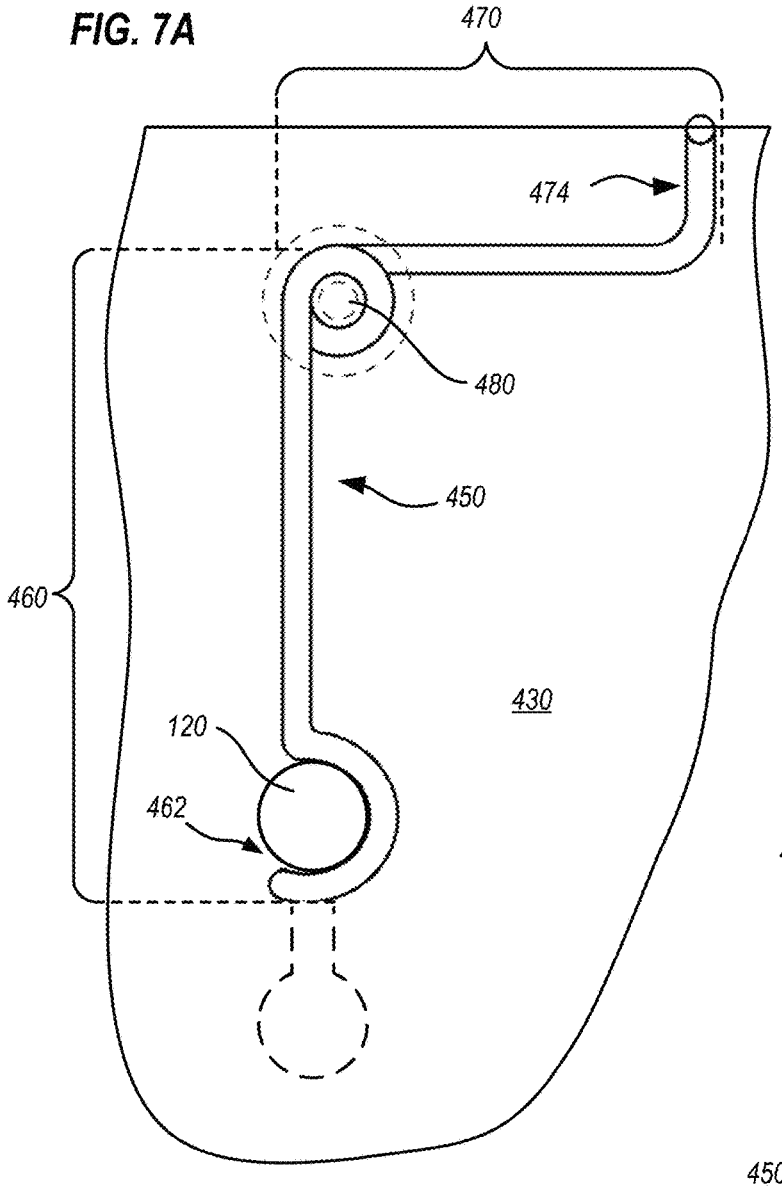
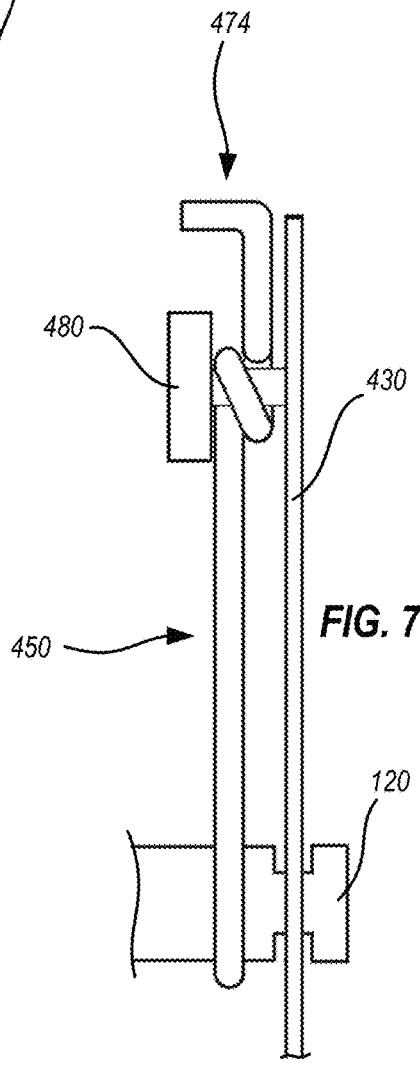
FIG. 7B

FIG. 8A
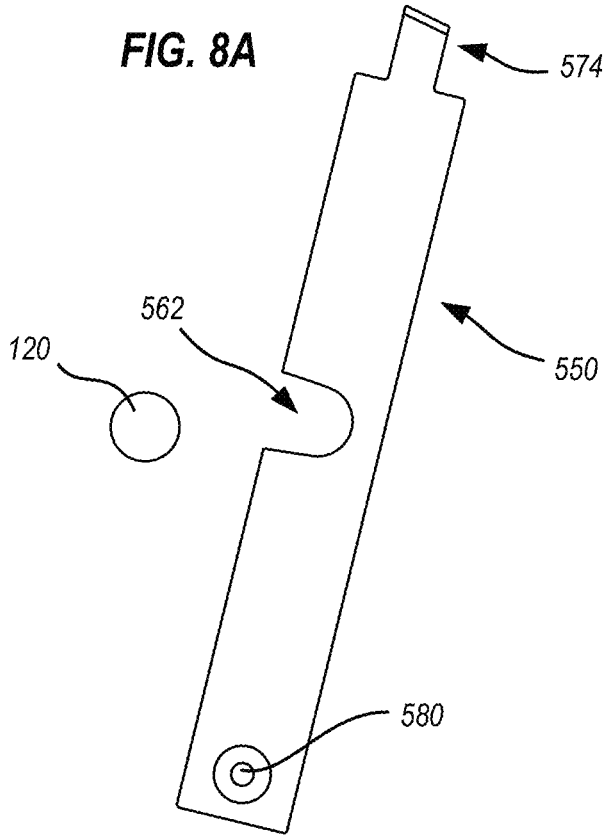
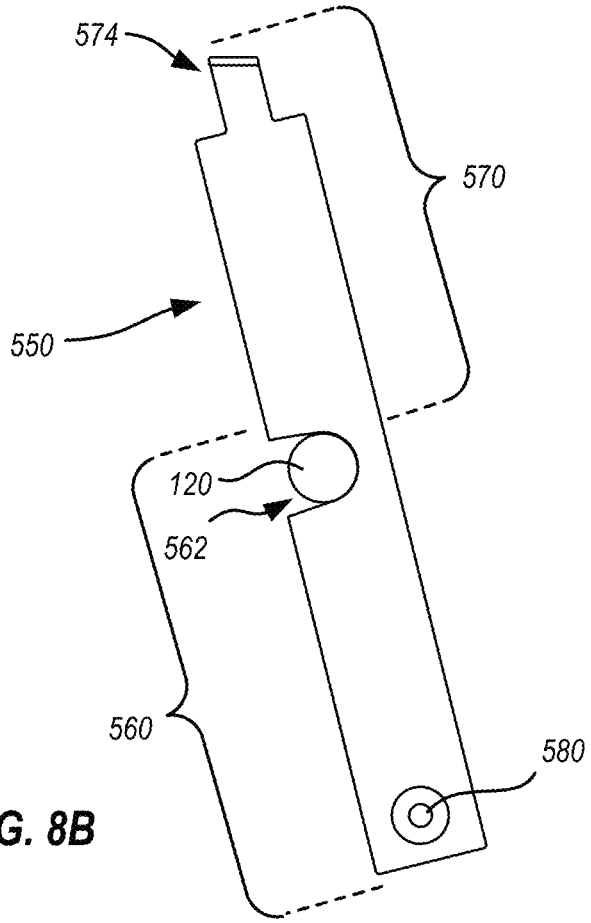
FIG. 8B

LUMINAIRE INSTALLATION APPARATUS AND METHODS

BACKGROUND

Luminaires, or light fixtures, for built-in installation may be designed to meet goals such as emitted light distribution, power consumption, cost, size, and visual aesthetics. Some luminaires are designed for mounting on walls and are supported by connections to the wall itself, or connections through the wall to structures behind the wall.

SUMMARY

In one or more embodiments, apparatus for coupling a luminaire with a surface includes a mounting plate that is configured for coupling with the surface, one or more studs fixedly coupled with the mounting plate, a back plate for a luminaire, and a latch disposed adjacent to a first one of the slots on the back plate. The one or more studs extend from the mounting plate and away from the surface. The back plate forms one or more slots that are configured to receive the one or more studs. The back plate can move in a first direction with the studs received within the one or more slots. The latch couples with the back plate through a rotatable coupler, and forms a first recess configured to engage a first one of the studs when the first one of the studs is received through the first one of the slots. In a first rotational position of the latch with respect to the back plate, the first recess does not engage the first one of the studs, and in a second rotational position of the latch with respect to the back plate, the latch engages the first one of the studs, so as to constrain movement of the back plate in a second direction that is different from the first direction, relative to the mounting plate, so as to constrain movement of the back plate in the first direction, latching the back plate to the mounting plate.

In one or more embodiments, apparatus for coupling a luminaire with a surface includes a back plate for a luminaire; one or more studs fixedly coupled with the back plate, wherein the one or more studs extend perpendicular to the back plate; and a mounting plate that is configured for coupling with the surface. The mounting plate forms one or more slots that are configured to receive the one or more studs, such that the back plate can move in a first direction relative to the mounting plate with the studs received within the one or more slots. The apparatus also includes a latch that is rotatably coupled with the mounting plate adjacent to a first one of the studs. The latch forms a first recess configured to engage the first one of the studs in a second direction that is different from the first direction. In a first rotational position of the latch with respect to the back plate, the first recess does not engage the first one of the studs. In a second rotational position of the latch with respect to the back plate, the first recess engages the first one of the studs, so as to constrain movement of the back plate in the second direction, relative to the mounting plate, latching the back plate to the mounting plate.

In one or more embodiments, a method couples a luminaire with a surface. The method includes coupling a mounting plate with the surface. One or more studs extend from the mounting in a perpendicular direction from the mounting plate. The method includes positioning a back plate of the luminaire in proximity to the mounting plate. One or more slots of the back plate receive respective ones of the studs within the slots. The one or more slots limit movement of the back plate with respect to the studs in a first direction. The method also includes moving the back plate in a second direction that is different from the first direction, so that the back plate reaches a mounting position relative to the one or more studs. The method further includes rotating a latch from a first rotational position, in which a recess of the latch is clear of a first one of the studs, to a second rotational position, in which the recess of the latch engages the first one of the studs, and limits the movement of the back plate with respect to the studs in the second direction.

BRIEF DESCRIPTION OF THE DRAWINGS

Embodiments are described in detail below with reference to the following figures.

FIG. 3 is a schematic, isometric view of a latch, provided as a rear view at a slight angle to show out-of-plane features of the latch, according to one or more embodiments.

FIG. 4A is a front elevation that schematically illustrates the latch of FIG. 3 in a first rotational position, with a latch portion away from a corresponding stud, according to one or more embodiments.

FIG. 4B is a front elevation that schematically illustrates the latch of FIG. 3 in a second rotational position, with the latch portion engaging the corresponding stud.

FIG. 6A schematically illustrates another latch that secures a back plate of a luminaire to a mounting plate, in a first rotational position, according to one or more embodiments.

FIG. 6B schematically illustrates the latch of FIG. 6A in a second rotational position, with a recess of a latch portion engaging a stud, according to one or more embodiments.

FIG. 7A is an isometric view, substantially perpendicular to a back plate of a luminaire, that schematically illustrates another latch in a rotational position that allows it to engage a stud of a mounting plate, according to one or more embodiments.

FIG. 7B is an isometric view of the latch of FIG. 7A, oriented substantially parallel with the mounting plate and a back plate, according to one or more embodiments.

FIG. 8A schematically illustrates another latch in a first rotational position, according to one or more embodiments.

FIG. 8B schematically illustrates the latch of FIG. 8A in a second rotational position, with a recess of a latch portion engaging a stud.

DETAILED DESCRIPTION

The subject matter of embodiments herein is described here with specificity to meet statutory requirements, but this description is not intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Examples are provided by way of illustration and/or explanation, and not as limitations. For instance, features illustrated or described as part of one embodiment may be used on another embodiment to yield a further embodiment. Upon reading and comprehending the present disclosure, one of ordinary skill in the art will readily conceive many equivalents, extensions, and alternatives to the specific, disclosed luminaire types, all of which are within the scope of embodiments herein.

Figure 2:
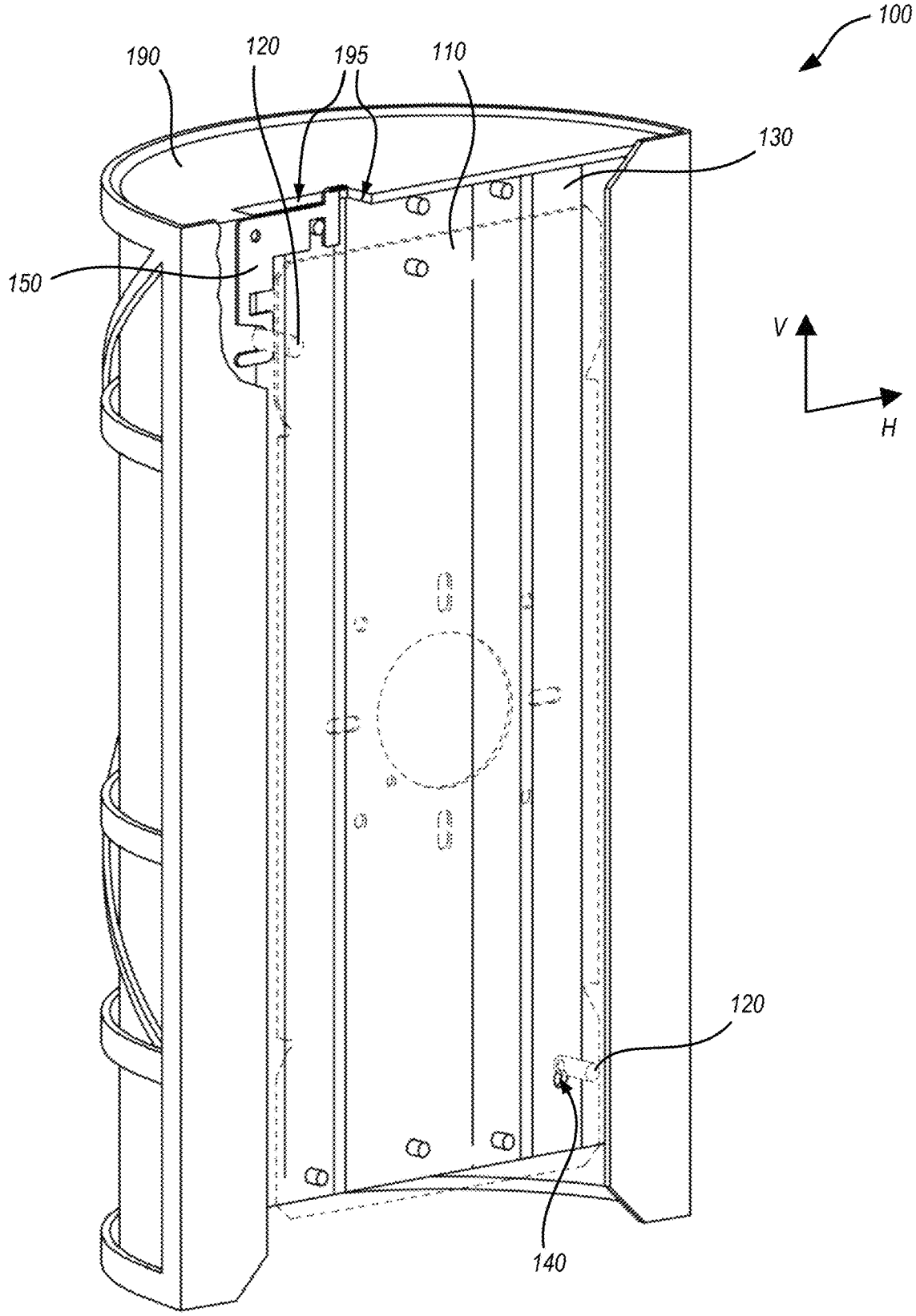
FIG. 2 is a schematic rear isometric view illustrating a latch that secures the back plate of the luminaire shown in FIG. 1, to the mounting plate shown, according to one or more embodiments.

In the following description, positional terms like "above," "below," "vertical," "horizontal" and the like are sometimes used to aid in understanding features illustrated in the drawings as presented, that is, in the orientation in which labels of the drawings read normally. These meanings are adhered to, notwithstanding that the luminaires herein may be mounted to surfaces that are not vertical. Also, the relative terms "proximal" and "distal" are used relative to the uppermost features of the luminaire shown in FIG. 2; that is, locations nearer to the physical top of housing 190 are proximal and locations beneath this physical top, in the orientation of FIG. 2, are distal.

Certain embodiments herein provide apparatus for mounting a luminaire to a wall. In these embodiments, a hole in the wall allows access to structural support (for example, a junction box) behind the wall. A mounting plate is mounted to the structural support. The mounting plate forms features that the luminaire can engage with. The luminaire engages with these features, and is thus secured to the wall.

Figure 1:
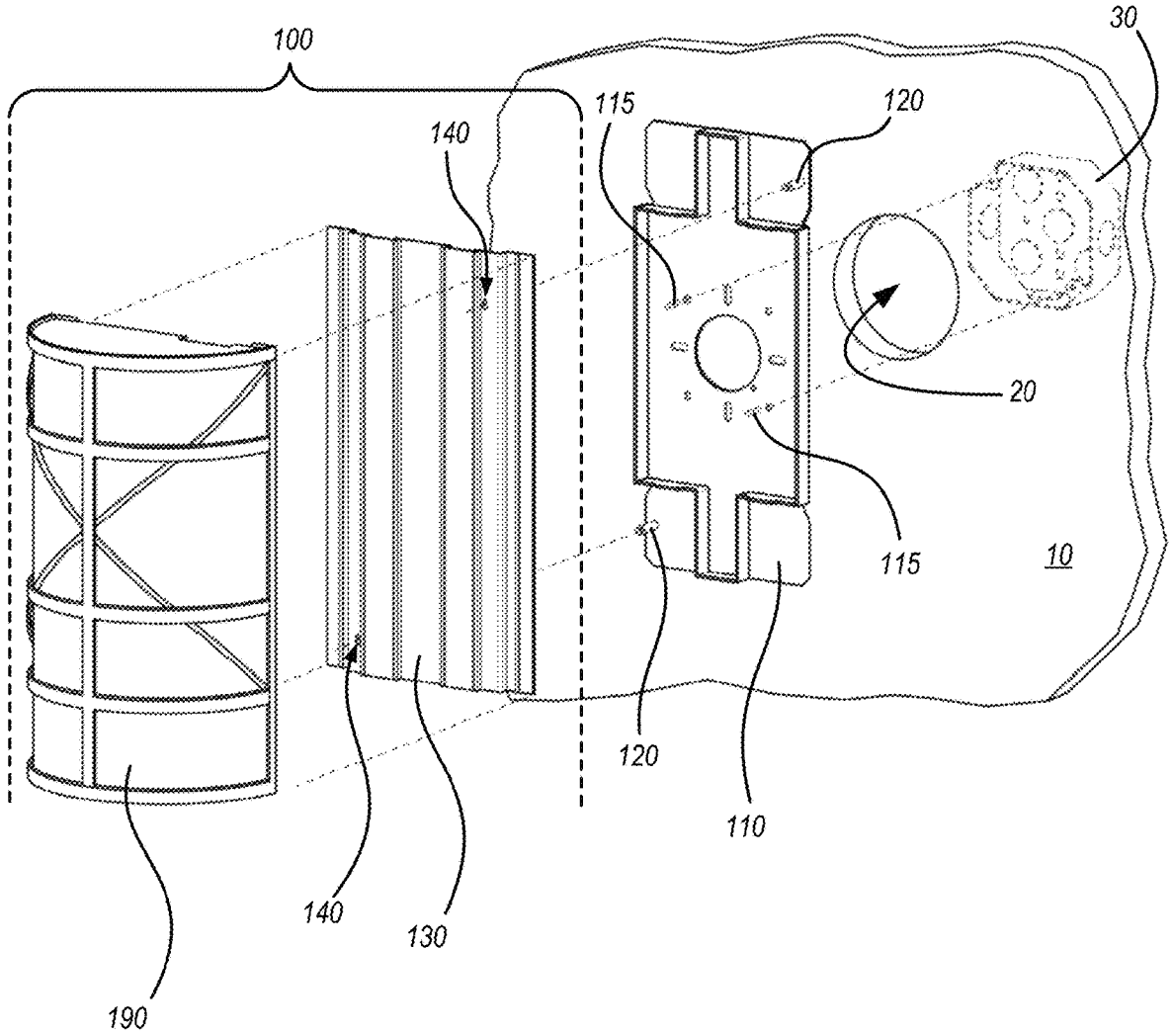
FIG. 1 is a schematic exploded view illustrating a luminaire mounting plate that couples with a junction box, and a back plate of a luminaire that couples with the mounting plate, according to one or more embodiments.

FIG. 1 is a schematic exploded view illustrating a luminaire 100 that couples with mounting plate 110 that, in turn, couples with structural support such as a junction box 30. Luminaire 100 includes a luminaire housing 190 to which lighting components are coupled, for example one or more light engines that are configured to convert external power to light. Luminaire housing 190 includes a back plate 130 (part of, but shown exploded from, housing 190) that couples with mounting plate 110. Mounting plate 110 may be considered part of a luminaire 100, or may be provided separately from luminaire 100. Mounting plate 110 may couple with junction box 30, for example, using screws 115 that pass through a hole 20 in wall 10, or by any other suitable means. One or more studs 120 may extend from (e.g., are fixedly coupled with) mounting plate 110; studs 120 may, but are not required to, extend perpendicularly from mounting plate 110. One or more slots 140 of back plate 130 are configured to couple with studs 120, so that luminaire 100 couples with junction box 30 through mounting plate 110. One skilled in the art will appreciate that back plate 130 and thus luminaire 100 may be supported by a single stud 120. However, use of two or more studs 120 may help stabilize luminaire 100 by preventing rotation of luminaire 100 about a single stud 120, may spread the weight of luminaire 100 across more than one stud 120, and may provide redundancy in case of failure of one stud 120. In certain embodiments, slots 140 may be formed by keyhole apertures; back plate 130 may initially be aligned with studs 120 so that enlarged lower portions of slots 140 can be placed over studs 120, after which luminaire 100 slides in a direction as limited by slots 140 (vertical direction V in FIG. 2). Luminaire 100 can slide until one or more upper portions of slots 140 rest against studs 120. At this position, slots 140 limit further downward motion of back plate 130, and because slots 140 are only slightly larger than the engaged portions of studs 120, slots 140 limit any sideways motion (e.g., in horizontal direction H in FIG. 2). Other arrangements are possible in other embodiments.

The hardware and procedures described above may be sufficient to couple luminaire 100 with mounting plate 110 and thus with wall 10. However, with only the features described above, it may be possible to bump or jar luminaire 100 such that luminaire housing 190 moves upwards in direction V, potentially dislodging back plate 130 and luminaire housing 190 from studs 120 and mounting plate 110. Because luminaire 100 is generally connected by wiring to power within junction box 30, if dislodged, luminaire housing 190 would fall until caught by the wiring. This creates hazards of (1) luminaire housing 190 injuring or damaging persons or property by falling on them, and/or (2) electrical short circuit or fire hazards caused by damage to the wiring, contact between wires and one another, or contact by wires to adjacent objects.

To help prevent possible damage, injury or fire, a latch has been developed for luminaire 100 to constrain movement of back plate 130 relative to studs 120 after installation, as described below.

FIG. 2 is a schematic cutaway isometric view illustrating certain components of luminaire 100, illustrating a latch 150 that secures back plate 130 of luminaire 100, to mounting plate 110. Latch 150 constrains movement of back plate 130 in the direction of slots 140, which prevents luminaire housing 190 (including back plate 130) dislodging from mounting plate 110. Details of latch 150 are shown in FIG. 3, and operation of latch 150 is described in connection with FIGS. 4A and 4B. FIG. 2 also illustrates an optional recess 195 in luminaire housing 190 that may be provided to improve accessibility of an upper portion of latch 150 (e.g., proximal portion 174 as discussed in FIGS. 3, 4A and 4B). Recess 195 may be, for example, a few tenths of an inch deep (e.g., in a direction perpendicular to wall 10, FIG. 1) and one to two inches long, just enough to make it easier for human fingers to grasp and move latch 150 while luminaire 100 is installed with back plate 130 near a wall.

FIG. 3 is a schematic, isometric view of latch 150, provided as a rear view at a slight angle to show out-of-plane features of latch 150. Latch 150 (with or without rotatable coupler 180, as discussed below) may be formed, for example, from sheet or rod metal, other forms of metal, plastic and/or ceramic, and may be manufactured by any suitable method such as stamping, bending, molding, casting, milling or three-dimensional (3D) printing. Latch 150 includes a latch portion 160 that forms a recess 162 sized to accommodate a stud 120 of mounting plate 110, as discussed above. Latch 150 forms a handle portion 170 that is positioned within a luminaire (e.g., luminaire 100) so as to be reachable by an installer. Latch portion and handle portion 170 may overlap, as shown in FIG. 3; the defining feature of latch portion 160 is that it includes recess 162, and the defining feature of handle portion 170 is that it is reachable by an installer. A proximal end 174 of handle portion 170 may be formed with an out-of-plane curve, as shown, to provide an advantageous feature for grasping with fingers. In the position shown in FIG. 2, the handle portion of latch 150 may be considered substantially within recess 195 when only the upper portion of the latch is accessible, but when latch 150 rotates to release stud 120, the handle portion may be considered to extend from recess 195. Latch portion 160 and/or handle portion 170 may also form optional recesses 176 to accommodate features of back plate 130 or mounting plate 110 that are not necessarily part of the latch assembly (e.g., features 122 shown in FIGS. 4A and 4B).

A rotatable coupler 180 couples latch 150 with back plate 130 so that latch 150 can rotate relative to back plate 130. Rotatable coupler 180 may be, for example, a rivet, a screw or an axle, and may be formed of any mechanically suitable material. Rotatable coupler 180 can also be a protrusion of latch 150, extending through an aperture formed in back plate 130. When rotatable coupler 180 is a protrusion of latch 150, it may be initially formed as a feature having three sides separated from the rest of latch 150 by stamping, with the feature then being bent until it is roughly perpendicular to the rest of latch 150. Then, to couple latch 150 with back plate 130, the feature may be inserted through an aperture in back plate 130 and the tip of the feature bent over so that latch 150 does not easily dislodge from back plate 130.

FIG. 4A schematically illustrates latch 150 in the first rotational position with latch portion 160 and recess 162 away from stud 120, and FIG. 4B schematically illustrates latch 150 in the second rotational position with recess 162 engaging stud 120. For clarity, the portion of stud 120 that is illustrated in FIGS. 4A and 4B is a cross-section at the plane of latch 150; outer and/or inner portions of stud 120 may be smaller or larger so that studs 120 can engage slots 140 of back plate 130 (see, e.g., FIGS. 2 and 7B).

As noted in connection with FIG. 2, slots 140 limit motion of back plate 130 in the H direction. Because recess 162 engages stud 120 in a transverse direction (e.g., the V direction shown in FIGS. 4A and 4B) relative to the direction of slots 140, latch 150 constrains movement of back plate 130 in the direction of slot 140, and thus latches back plate 130 securely to mounting plate 110.

Latch portion 160 and/or handle portion 170 of latch 150 may form recesses 176, as shown, to accommodate features 122 of back plate 130 such as mounting hardware, wiring and the like. In some cases, features 122 can cooperate with latch 150 to keep it from rotating to a position where proximal end 174 is inaccessible, before latch 150 engages with a stud 120. For example, without a stud 120 to limit its rotation, latch 150 as shown in FIGS. 2, 3, 4A and 4B could be pulled downward by gravity such that proximal end 174 would be inaccessible within recess 195 when back plate 130 couples with mounting plate 110 (that is, when luminaire 100 is mounted on a wall). A feature 122 can limit rotation of handle portion 170 so that proximal end 174 remains accessible above housing 190, as shown in FIG. 2. (Similarly, a feature like feature 122 could limit rotation of a latch portion, or such feature could be part of a mounting plate instead of a base plate, for the same purpose.) In other embodiments of latches herein, a latch portion or a handle portion may not necessarily form a recess at a location where a feature 122 would contact the corresponding latch portion or handle portion, yet one or more features similar to feature 122 may be provided to limit rotation of the latch.

Latch 150 may be held in place in the first and/or second rotational positions in a variety of ways. For example, rotatable coupler 180 may provide some resistance to rotation (e.g., due to internal friction) such that latch 150 does not readily move unless a force is applied by fingers or a tool. Similarly, rotatable coupler 180 may hold latch 150 closely against back plate 130 such that friction exists between latch 150 and back plate 130. In another example, latch 150 may fit closely with one or more surfaces of stud 120 such that in the second rotational position, friction between stud 120 and latch 150 holds latch 150 in position. In yet another example, a spring may bias latch 150 toward the first or the second rotational position (see, e.g., FIG. 9).

Figure 5:
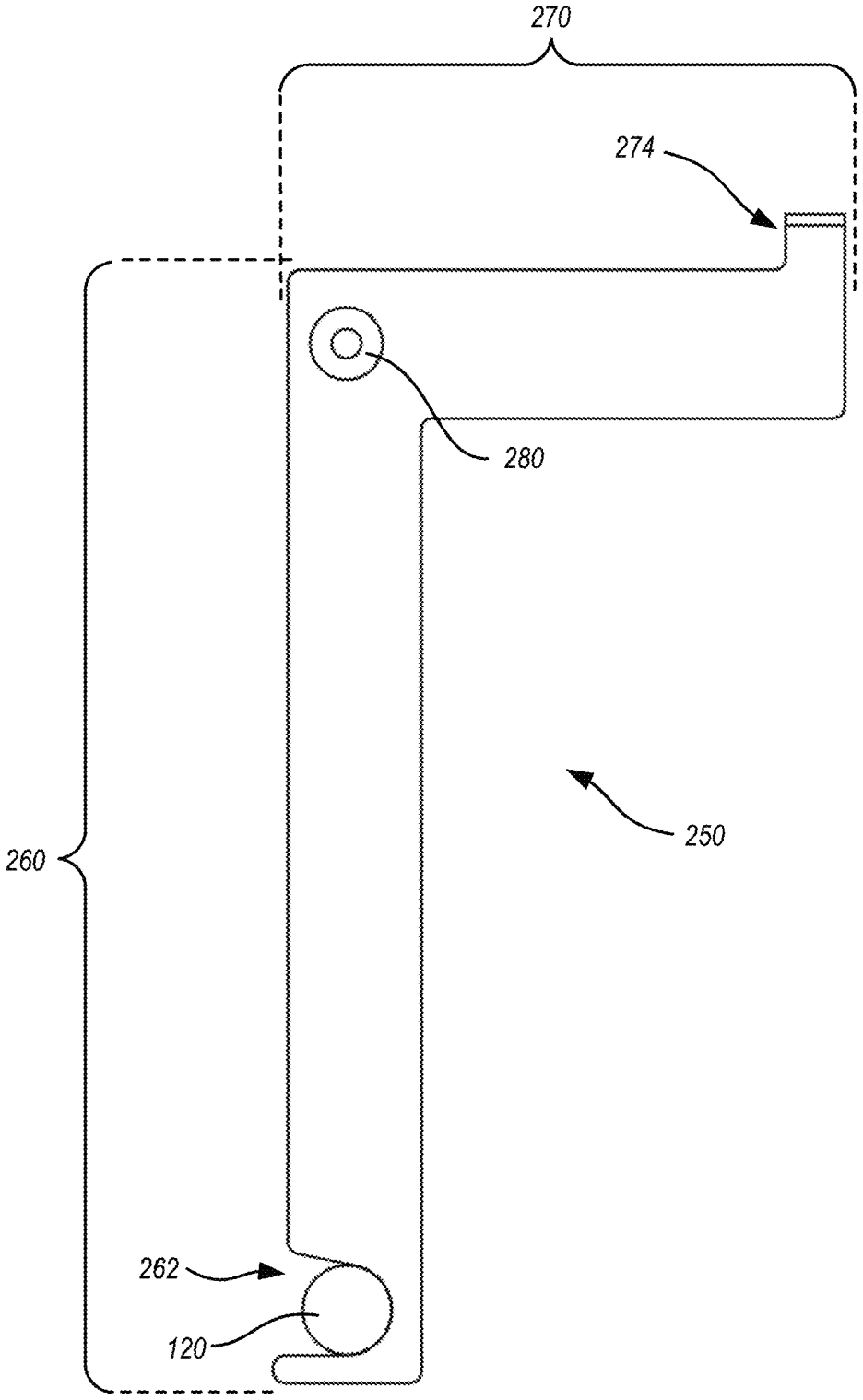
FIG. 5 schematically illustrates another latch that secures a back plate of a luminaire to a mounting plate, according to one or more embodiments.

FIG. 5 schematically illustrates an alternate embodiment of a latch 250, that secures a back plate of a luminaire to a mounting plate. Latch 250 includes a latch portion 260 with a recess 262 therein, configured to engage a stud 120 of a mounting plate (e.g., as shown in FIGS. 1 and 2). Latch portion 260 is longer than latch portion 160 of latch 150, to accommodate a position of stud 120 on a different mounting plate than mounting plate 110. Latch 250 includes a handle portion 270 with a proximal end 274 for grasping with fingers. Latch 250 couples through a rotatable coupler 280 with a back plate (not shown in FIG. 5, but comparable to back plate 130, FIGS. 1 and 2). Latch 250 lacks recesses to accommodate other features, which may not be present on or in the intended back plate and/or mounting plate. FIG. 5 illustrates the principle that a latch portion and a handle portion of latches herein need not be the same length as one another, but can have different lengths to accommodate features of a back plate and/or mounting plate that they are intended for use with. One skilled in the art can use this and the other principles described herein to conceive many variations, equivalents and enhancements, all of which are within the scope of the present disclosure.

FIG. 6A schematically illustrates a latch 350 in a first rotational position, and FIG. 6B schematically illustrates latch 350 in a second rotational position, with a recess 362 of a latch portion 360 engaging stud 120. As shown, latch 350 includes a handle portion 370 with a proximal end 374 for grasping with fingers, and a latch portion 360 with a recess 362 therein, configured to engage a stud 120 of a mounting plate (e.g., as shown in FIGS. 1 and 2). Latch 350 couples through a rotatable coupler 380 with a back plate (not shown in FIGS. 6A and 6B, but similar to back plate 130, FIGS. 1 and 2). Latch portion 360 is longer than latch portion 160 of latch 150, to accommodate a position of stud 120 on a different mounting plate than mounting plate 110. Also, latch portion 360 and handle portion 370 form a different angle than the substantially ninety degree angle formed by the latch and handle portions of latches 150 and 250. This may be especially advantageous when a back plate forms slots at an angle other than vertical, for example like slots 340 illustrated in broken lines. Latch 350 could be used with a back plate having vertical slots for studs 120, but the degree to which a latch (e.g., latch 350) secures its back plate to a mounting plate may be improved when the direction in which the latch engages the stud is substantially perpendicular to the direction of the corresponding slot. Thus, FIGS. 6A and 6B illustrate the principle that a latch portion and a handle portion of latches herein need not form substantially ninety degree angles with respect to one another, but can have different angles to accommodate features of a back plate and/or mounting plate that they are intended for use with. Latch 350 also lacks recesses to accommodate other features, which may not be present on or in the intended back plate and/or mounting plate.

FIG. 7A is a rear elevation of a back plate 430 of a luminaire, that schematically illustrates a latch 450 in a rotational position that allows it to engage a stud 120 of a mounting plate (the mounting plate is not shown in FIGS. 7A and 7B, but is similar to mounting plate 110, FIGS. 1 and 2). FIG. 7B is a side elevation taken substantially parallel with back plate 430. FIGS. 7A and 7B schematically illustrate how latch 450 can be formed by bending a round member (e.g., bar or wire stock) into a shape that allows latch 450 to function much like latches 150, 250 and 350 discussed above. In the rotational position shown in both FIGS. 7A and 7B, a recess 462 of latch 450 engages a stud 120 of a mounting plate (e.g., as shown in FIGS. 1 and 2). As shown, latch 450 includes a handle portion 470 with a proximal end 474 for grasping with fingers, and a latch portion 460 with recess 462 therein, configured to engage stud 120 of a mounting plate (e.g., as shown in FIGS. 1 and 2). Latch 450 couples with a rotatable coupler 480 that may be, for example, a screw that is received by an aperture in or through back plate 430. FIGS. 7A and 7B illustrate the principle that a latch may be formed of a round member that is bent or twisted into a suitable shape, and that a rotating coupler for a latch herein can be formed of a screw that is received by an aperture in or through a back plate.

FIG. 8A schematically illustrates a latch 550 in a first rotational position, and FIG. 8B schematically illustrates latch 550 in a second rotational position, with a recess 562 of a latch portion 560 engaging stud 120. As shown, latch 550 includes a handle portion 570 with a proximal end 574 for grasping with fingers, and a latch portion 560 with a recess 562 therein, configured to engage a stud 120 of a mounting plate (e.g., as shown in FIGS. 1 and 2). Latch 550 couples through a rotatable coupler 580 with a back plate (not shown in FIGS. 8A and 8B, but similar to back plate 130, FIGS. 1 and 2). In latch 550, recess 562 is between rotatable coupler 580 and proximal end 574, rather than having the rotatable coupler be between the recess and the proximal end, as in FIGS. 1 through 7B. Also, latch 550 forms no angle between latch portion 560 and handle portion 570, as shown. Thus, FIGS. 8A and 8B illustrate the principles that a latch portion and a handle portion of latches herein can be in line with one another, that is, they need not form any angle with respect to one another, and both can be on the same side of a rotatable coupler.

Figure 9:
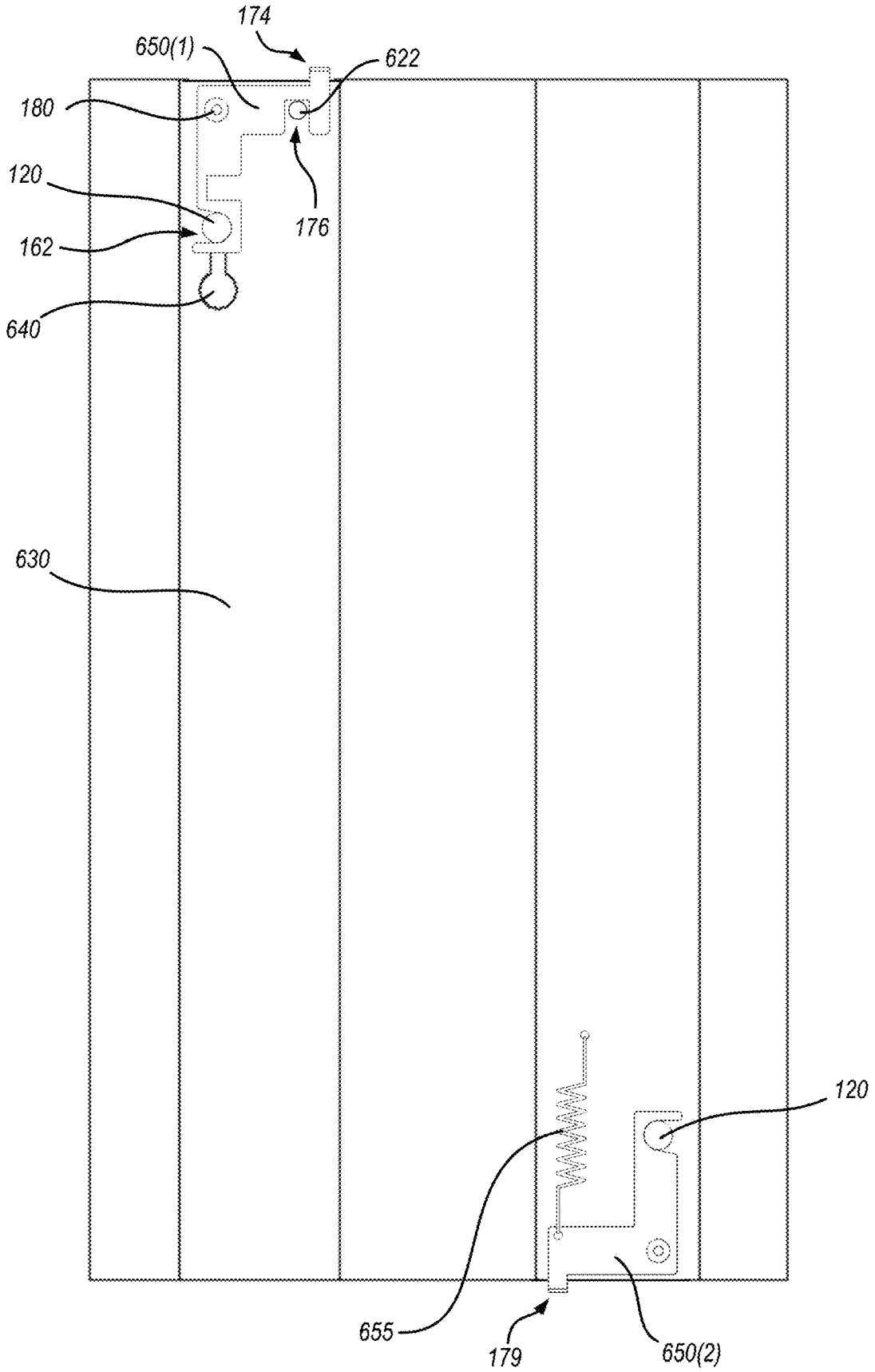
FIG. 9 schematically illustrates a back plate that includes two latches that can latch the back plate to studs of a mounting plate, according to one or more embodiments.

FIG. 9 schematically illustrates a back plate 630 for a luminaire. Back plate 630 includes latches 650(1) and 650(2) that can latch back plate 630 to studs 120 of a mounting plate. Use of two (or more) latches can increase the security of a luminaire's coupling to a mounting plate, by providing multiple fastening points for mechanical security and to provide redundancy in case of failure of a single latch or stud. Features and orientation of latch 650(1) are substantially similar to latch 150 illustrated in FIGS. 2, 3, 4A and 4B. Latch 650(1) couples with back plate 630 through a rotatable coupler 180, and like latch 150, has a proximal end 174, a recess 162 configured to engage stud 120, and a recess 176 to accommodate a feature 622 of back plate 630.

Latch 650(2) is similar to latch 650(1), with some differences as now discussed. Latch 650(2) is oriented upside down relative to latch 650(1), so that when installed in a conventional orientation (e.g., as shown in FIG. 9) gravity will not urge latch 650(2) to rotate to a position within the associated luminaire, but will instead urge latch 650(2) to rotate to a position in which it extends downward from the luminaire. Thus, no internal feature (e.g., like feature 122 associated with latch 150 or feature 622 associated with latch 650(1)) is needed to keep a distal end 179 accessible. Instead, latch 650(2) is spring loaded. In the example shown in FIG. 9, a spring 655 couples latch 650(2) with back plate 630. Spring 655 is configured so as to pull distal end 179 upwards in the orientation of FIG. 9, until either (1) latch 650(2) engages stud 120, limiting further rotation of latch 650(2), or (2) spring 655 reaches a neutral flexure position such that spring 655 no longer continues to pull upward. One of ordinary skill in the art will recognize that other equivalents, alternatives and variations to the spring loading mechanism illustrated in FIG. 9 are possible, and all are considered within the scope of the present disclosure.

The apparatus herein enables methods of coupling a luminaire to a surface. For example, one method of coupling a luminaire to a surface includes coupling a mounting plate with the surface, for example by coupling the mounting plate with a junction box that is mounted behind the surface, as suggested by FIG. 1. The mounting plate may have one or more studs extending therefrom, e.g., like studs 120 extend from mounting plate 110, FIG. 1. The method then positions a back plate of the luminaire in proximity to the mounting plate, such that the studs are received through respective slots formed in the back plate. The slots limit movement of the back plate with respect to the studs in a first direction (e.g., the H direction as shown in FIG. 2). The method then moves the back plate in the first direction so that the back plate reaches a mounting position relative to the studs. For example, this can occur when back plate 130 moves until stud(s) 120 reach the top(s) of slots(s) 140 as shown in FIGS. 1 and 2. Finally, a latch moves from a first rotational position to a second rotational position, such that a recess of the latch engages one of the studs. While engaged, the latch limits movement of the back plate with respect to the stud in a second position (e.g., the V direction as shown in FIG. 2). One skilled in the art will readily conceive of many variations, equivalents and enhancements of this method, all of which are within the scope of the present disclosure.

The foregoing is provided for purposes of illustrating, explaining, and describing embodiments herein. Further modifications and adaptations to these embodiments will be apparent to those skilled in the art and may be made without departing from the scope or spirit of the invention. Different arrangements of the components depicted in the drawings or described above, as well as components and steps not shown or described, are possible. Similarly, some features and subcombinations are useful and may be employed without reference to other features and subcombinations. Embodiments have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. Apparatus for coupling a luminaire with a surface, the apparatus comprising:

a mounting plate that is configured for coupling with the surface, wherein, when coupled with the surface, the mounting plate is parallel with the surface;

one or more studs fixedly coupled with the mounting plate, wherein the one or more studs extend perpendicularly from the mounting plate and perpendicularly away from the surface;

a back plate for a luminaire, the back plate forming one or more slots therethrough, wherein the slots are configured to receive the one or more studs, such that the back plate can move vertically with the studs received within the one or more slots; and a latch disposed adjacent to a first one of the slots on the back plate, wherein:

the latch couples with the back plate through a rotatable coupler;

the latch forms a first recess configured to engage a first one of the studs when the first one of the studs is received through the first one of the slots;

in a first rotational position of the latch with respect to the back plate, the first recess does not engage the first one of the studs, and in a second rotational position of the latch with respect to the back plate, the first recess engages the first one of the studs so as to constrain vertical movement of the back plate, latching the back plate to the mounting plate such that the latch will resist movement of the back plate if an upward force is applied to the back plate.

2. The apparatus of claim 1, wherein the latch comprises:

a latch portion that forms the first recess; and a handle portion, wherein a proximal end of the handle portion is accessible when the latch is in either the first rotational position or the second rotational position.

3. The apparatus of claim 2, wherein:

the latch portion and the handle portion are formed of a single piece of metal that is disposed orthogonal to an axis of rotation of the rotatable coupler.

4. The apparatus of claim 3, wherein at least one of the back plate or the mounting plate defines a second recess, and the handle portion of the latch is substantially within the second recess in the second rotational position, but the handle portion of the latch extends from the second recess in the first rotational position.

5. The apparatus of claim 2, wherein the rotatable coupler is disposed between the handle portion and the latch portion of the latch.

6. The apparatus of claim 2, wherein the latch portion is disposed between the handle portion and the rotatable coupler.

7. The apparatus of claim 1, the apparatus comprising at least two of the studs and at least two of the latches, each latch being configured to couple with a corresponding one of the studs.

8. The apparatus of claim 1, wherein at least one of the back plate or the mounting plate includes a feature that blocks a portion of the latch from rotating beyond the second rotational position when the first one of the studs is not received through the first one of the slots.

9. The apparatus of claim 1, wherein the latch is held by friction when the latch is in the second rotational position.

10. The apparatus of claim 9, wherein the friction is between the latch and the first one of the studs.

11. The apparatus of claim 9, wherein the friction is between the latch and the back plate.

12. The apparatus of claim 1, wherein the latch is biased by a spring toward the second rotational position.

13. The apparatus of claim 1, wherein:

at least a first one of the one or more slots through the back plate is a keyhole slot that forms a narrow portion and a wide portion;

a length of the narrow portion of the first one of the slots is along the vertical direction; and the first one of the studs forms:

a head that is configured to fit through the wide portion of the slots but not the narrow portion of the slots, and a neck that is narrower than the head, and is configured to fit through either the narrow portion or the wide portion of the slots;

and wherein the first recess engages the head of the first one of the studs.

14. Apparatus for coupling a luminaire with a surface, the apparatus comprising:

a back plate for a luminaire, the back plate including one or more studs fixedly coupled thereto;

a mounting plate that is configured for coupling with the surface, the mounting plate forming one or more slots therethrough, wherein:

the studs extend perpendicularly with respect to the back plate, the mounting plate and the surface, when the mounting plate is coupled with the surface, and the slots are configured to receive the one or more studs, such that the back plate can move vertically relative to the mounting plate with the studs received within the one or more slots; and a latch that is rotatably coupled with the mounting plate adjacent to a first one of the studs, the latch forming a first recess configured to engage the first one of the studs n, and wherein:

in a first rotational position of the latch with respect to the back plate, the first recess does not engage the first one of the studs, and in a second rotational position of the latch with respect to the back plate, the first recess engages the first one of the studs, so as to constrain vertical movement of the back plate, relative to the mounting plate, latching the back plate to the mounting plate such that the latch will resist movement of the back plate if an upward force is applied to the back plate.

15. A method for coupling a luminaire with a surface, comprising:

coupling a mounting plate with the surface, wherein when the mounting plate is coupled with the surface, one or more studs extend from the mounting plate in a perpendicular direction from the mounting plate and from the surface;

positioning a back plate of the luminaire in proximity to the mounting plate, such that one or more vertical slots of the back plate receive respective ones of the studs within the slots, wherein the one or more slots limit horizontal movement of the back plate with respect to the studs;

moving the back plate in the vertical direction, so that the back plate reaches a mounting position relative to the one or more studs; and rotating a latch from a first rotational position, in which a recess of the latch is clear of a first one of the studs, to a second rotational position, in which the recess of the latch engages the first one of the studs, and limits movement of the back plate with respect to the studs if an upward force is applied to the back plate.

* * * * *